US006305497B1

(12) United States Patent
Simon

(10) Patent No.: US 6,305,497 B1
(45) **Date of Patent: *Oct. 23, 2001**

(54) MAST LADDER ASSEMBLY

(76) Inventor: Steve J. Simon, 1040 Birch St., Broomfield, CO (US) 80020

( * ) Notice: Subject to any disclaimer, the term of this patent is extended or adjusted under 35 U.S.C. 154(b) by 0 days.

This patent is subject to a terminal disclaimer.

(21) Appl. No.: 09/466,446

(22) Filed: Dec. 17, 1999

(51) Int. Cl.[7] ..... E06C 9/00
(52) U.S. Cl. ..... 182/100; 182/93; 114/90
(58) Field of Search ..... 182/100, 189, 182/93, 92, 194, 195, 151, 164; 114/90, 362

(56) References Cited

U.S. PATENT DOCUMENTS 826,863 * 7/1906 Lynch ..... 182/189
4,069,892 * 1/1978 Lynn ..... 182/189
4,577,726 * 3/1986 Wheeler ..... 182/93
4,607,725 * 8/1986 Brinkmann ..... 182/100
4,844,207 * 7/1989 Andrews ..... 182/100
6,076,634 * 6/2000 Simon ..... 182/93

FOREIGN PATENT DOCUMENTS

48492 * 9/1953 (IT) ..... 182/189

* cited by examiner

*Primary Examiner*—Alvin Chin-Shue
(74) *Attorney, Agent, or Firm*—H. Kenneth Johnston, II

(57) ABSTRACT

A mast ladder for going up the mast of a sailing craft having a mast with a sail slide extending along the length of the mast including a halyard slide, a plurality of connecting rods, a top step and a plurality of universal steps. The mast ladder is raised by engaging the top step with the sail slide and attaching a connecting rod to the lower end of the top step and raising the top step. The top step, each universal step and halyard slide, engage the sail slide keeping the mast ladder against the mast and providing support to each step. As the mast ladder is raised the top step has a connecting rod attached to the lower end of the top step and to the first universal step at its left or right hand position, which are alternated with a connecting rod between each universal step with the halyard slide connected upside down to the last universal step allowing the mast ladder to rest on the halyard slide so that the work on the craft may be completed.

6 Claims, 3 Drawing Sheets

MAST LADDER ASSEMBLY

BACKGROUND OF THE INVENTION

There are many times when one needs to perform some maintenance, normal or otherwise on the mast of a sailing craft. One traditional way of providing such access is to permanently mount steps to the mast. Such is shown by Jones, U.S. Pat. No. 186,424. Numerous disadvantages to this access is seen as chaffing of sails, snagging of halyards and adding additional wind resistance. Other means consist of using a boatswain's chair which requires additional help to raise the individual and is less than ideal in times of inclement weather as the boatswain chair can swing away form the mast during times the boat is rolling or pitching. There are some mast ladders which utilize the halyard to raise them but they are cumbersome, do not provide a sturdy climbing structure and in some cases require a substantial amount of storage for the mast ladder when not in use. Such is the Sailboat Mast Ladder, U.S. Pat. No. 4,577,726 which is a nylon strapping sewn together forming the foot loops and straight sections of the ladder and is stored as a complete unit which takes up precious space on a sailing craft. Although the halyard is used sometimes to raise a mast ladder, there are times when the halyard is not available and in such cases, there were no easy means to raise a ladder or get to the upper portion of the mast. There are numerous other pole climbing devices such as shown in Brookes et al. U.S. Pat. No. 3,995,714 which is a multi-section ladder but does not provide the needed requirements as set forth for a sailing craft. The device is cumbersome and consumes a substantial amount of space. Norton, U.S. Pat. No. 4,263,983 is a bulky and cumbersome device for use on a sailing craft. Sides et al., U.S. Pat. No. 4,674,598 which is a single pole hunting stand is basically unworkable on a sailing craft. It requires guy wires to support and is an unacceptable means of scaling a sailing craft's mast. Skyba, U.S. Pat. No. 5,109,954 again is a cumbersome device which although provides a useful tool for scaling trees, poles and the like from the ground where the device does not have any storage restrictions, but becomes unacceptable for use on a sailing craft. Zorn, U.S. Pat. No. 3,930,562 provides a removal step climbing assembly which allows one to climb the mast, however, one must insert the steps as one climbs and then remove them as one descends from the mast. Although it does work, it is certainly more dangerous having to install and remove the steps as one ascends and descends the mast. In Evans, U.S. Pat. No. 4,258,828, a folding ladder is shown which folds into the mast. Although it does provide that the steps are out of the way when not in use, they are still affixed to the mast and is a complex system for installation.

SUMMARY OF THE INVENTION

The invention is directed to a sailing craft mast ladder for use with a sailing craft that has a mast with a mast sail slide which extends along the length of the mast. The mast ladder has minimal parts. The top step is engaged with the sail slide and is connected to a universal step by a connecting rod. Each universal step is engaged with the sail slide and is connected to the previous universal step by a connecting rod and the halyard slide is engaged upside down in the sail slide and connected by a connecting rod and the mast ladder rests on the halyard slide. The top step, each universal step and the halyard slide fit into and slide in the mast slide providing a sturdy platform to climb and work.

It is a primary advantage of the within invention to eliminate many of the problems associated with permanent mast ladders and boatswain's chairs. The invention is assembled on the mast only when needed and eliminates the problems with the permanently mounted steps and does not subject the worker to the swinging problems of the boatswain's chair.

A key feature of the within invention is the use of the connecting rod which provides a uniform space between each step and is compact and stored easily. Additionally, a specific feature of the within invention is the universal step which keeps the requirement for many different parts limited. The universal step forms its portion of the mast ladder merely by inserting the universal step into the mast slide for the left side or for the right side depending which step is needed next.

An additional advantage of the within invention is that the sailing craft does not require any modifications to utilize the within invention. The mast slide which is used for raising and lowering the sails is utilized for raising the mast ladder.

Many time the halyard may come loose or unavailable and additional key feature of the within invention is that the halyard is not needed to assist in raising the mast ladder. The mast ladder rests on the halyard slide in the inverted position providing support for the mast ladder and individual using the device.

Other features and advantages of the present invention will appear from the following description in which the preferred embodiment has been set forth in detail in conjunction with the accompanying drawings.

DETAILED DESCRIPTION OF THE PREFERRED EMBODIMENT

Figure 1:
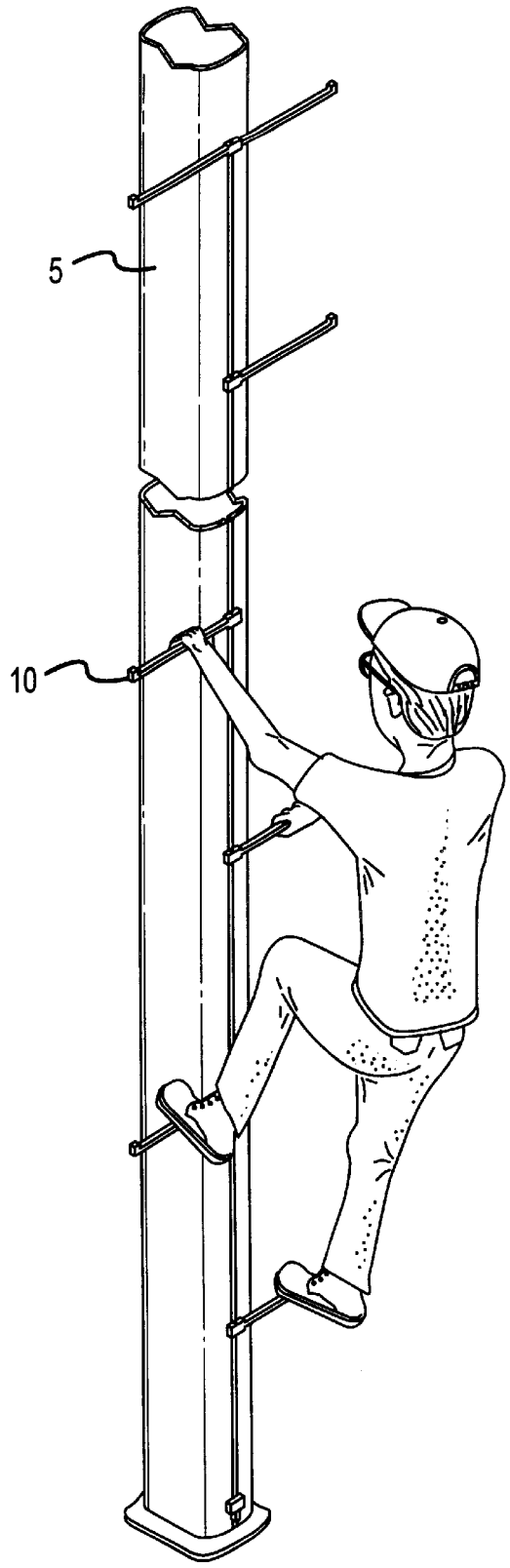
FIG. 1 is a perspective view showing the mast ladder made according to the invention in use.

Referring to the figures, as shown in FIG. 1, a mast ladder 10 made according to the invention is shown mounted to mast 5 of a sailing craft (not shown).

Figure 2:
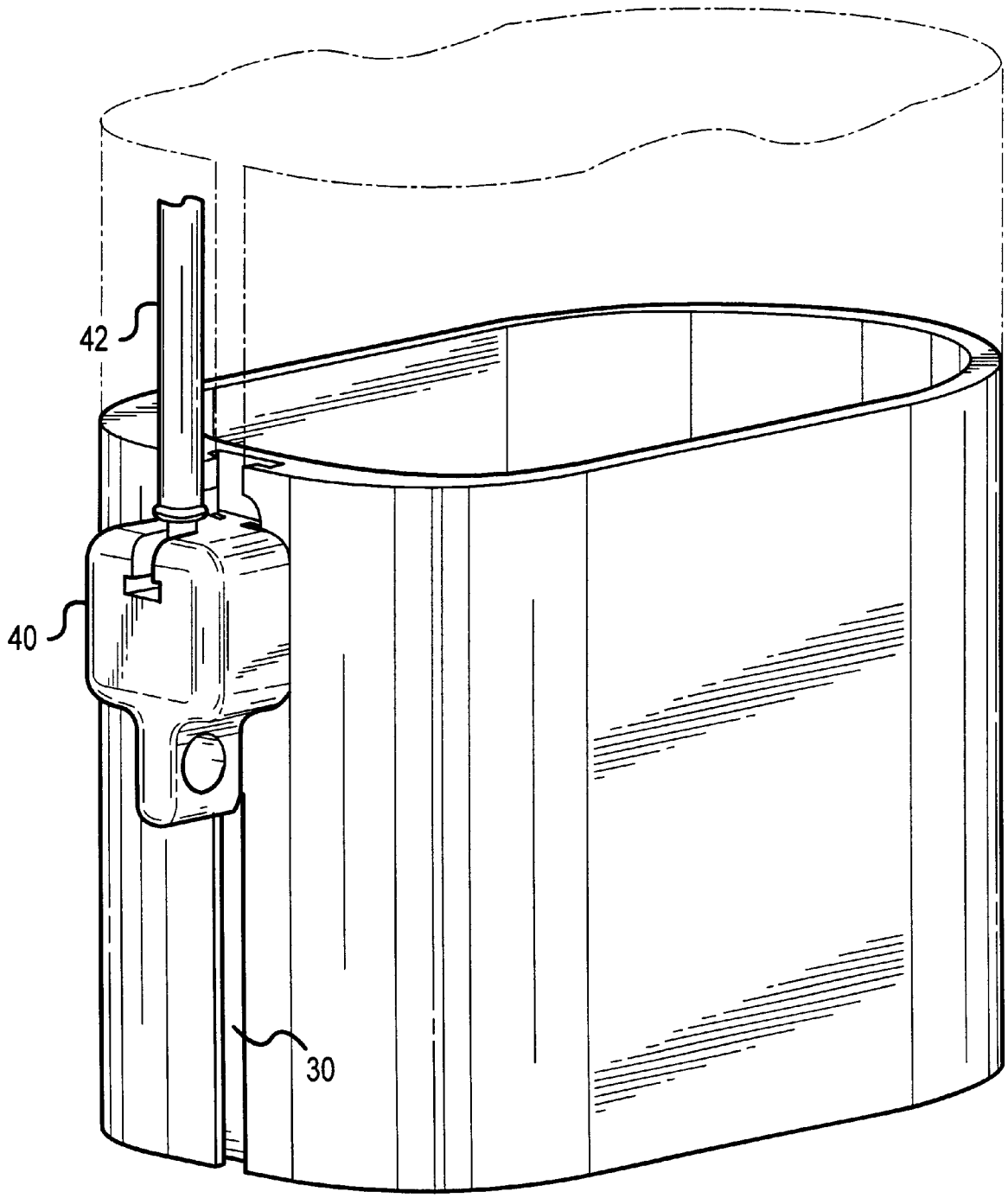
FIG. 2 is a perspective view showing the halyard slide in place supporting the mast ladder.
Figure 3:
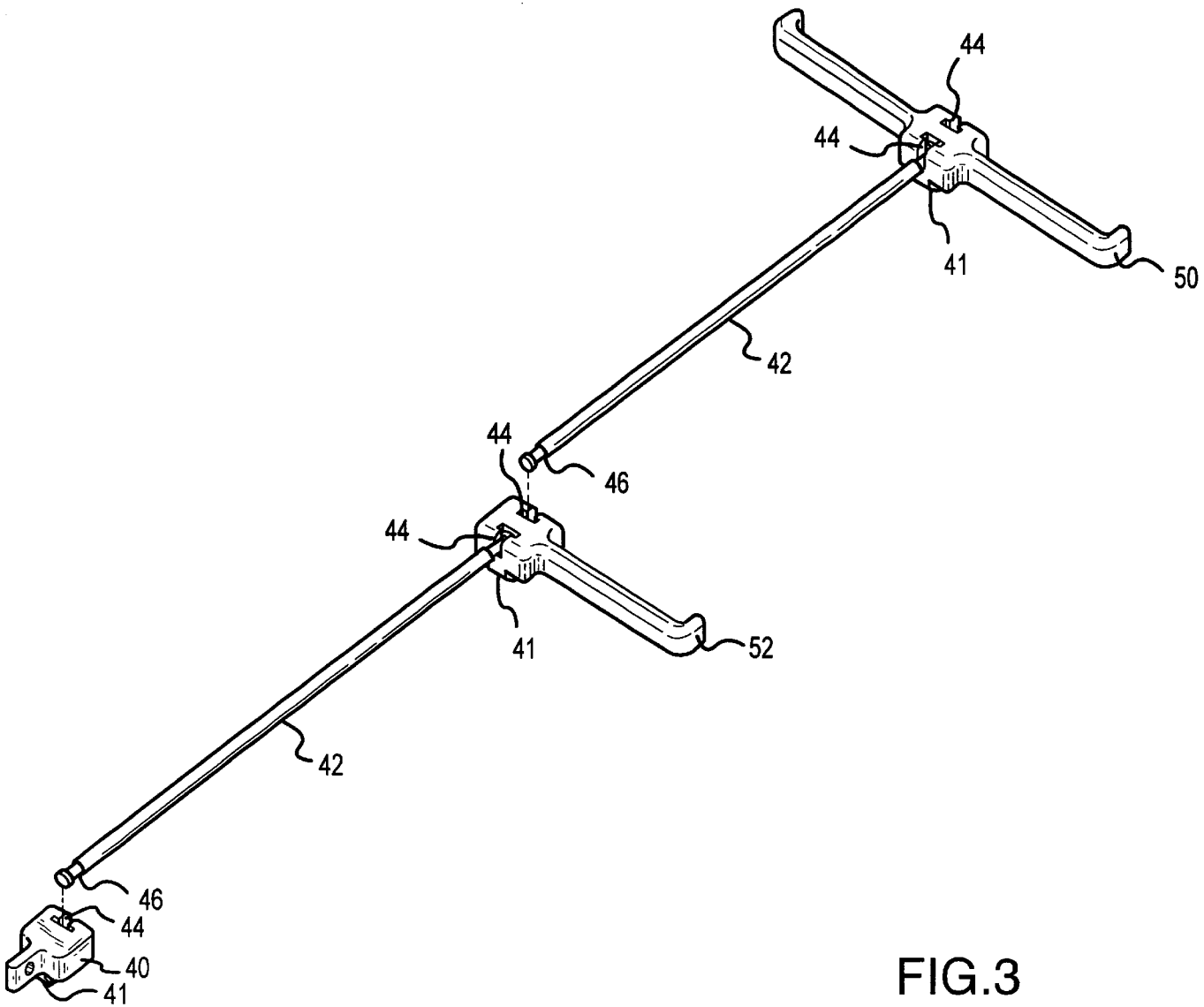
FIG. 3 is a perspective view showing the assembly of the mast ladder.

In operation, mast ladder 10 is made of aluminum and is assembled and raised by inserting the top step 50 into mast slide 30 and affixing connecting rod 42 in connecting slot 44. Connecting rod 42 has a connecting rod notch 46 at each end allowing connecting rod 42 to be inserted into connecting rod slot 44. The connecting rod 42 is then affixed to the lower portion of the top step 50 and the top step 50 is raised with the connecting rod 42. The top step 50 is wide enough for both feet of an individual to stand on in order to perform the necessary work for which the individual needed to go up the mast ladder 10. The connecting rod notch 46 of connecting rod 42 is inserted into one of the connecting rod slots 44 of the universal step 52 which is inserted into the mast slide 30 and raised by adding a connecting rod 42 and raising the mast ladder. The universal step 52 provides approximately one half of the step width of the top step 50. Thereafter, each universal step 52 is rotated prior to inserting into the mast slide 30 so that the universal step 52 alternates from the left to the right or the right to the left depending on the direction that the first universal step 52 was set as shown in FIG. 3. An "O" ring, (not shown) is placed on the inner most part of the connecting rod notch 46 to provide a snug fit to each of the attachments of the connecting rods 42 between the connecting rod slot 44 and the connecting rod notch 46. The "O" ring gives the mast ladder 10 some rigidity as the mast ladder 10 is assembled so that the connecting rods 42 do not separate at the connecting rod notch 46 and connecting rod slot 44. When the mast ladder is raised to the desired height a final connecting rod 42 is connected to the halyard slide 40 which is placed in the mast slide 30 inverted and the mast ladder 10 rests on the halyard slide 40 providing support for the mast ladder 10 and the individual using the mast ladder 10 as shown in FIG. 2.

Modifications and variations can be made to the disclosed embodiment without departing from the subject of the invention as defined in the following claims. For example, although the mast ladder 10 is described as being made from aluminum could be made of many other materials such as plastic or other material capable of supporting an individual. Additionally, the universal step 52 could be replaced by a dual step such as the top step 50. Another example is where the universal step 52 is utilized on the right or left side of the mast exclusively.

What I claim:

1. A mast ladder for use with a mast on a sailing craft having a sail slide along the length of the mast, the mast ladder comprising:

a top step means having a upper portion for providing support to an individual when said mast ladder is raised;

a first means for coupling said top step means to said sail slide;

said top step means having a lower portion having a connecting rod slot means for affixing a connecting rod means;

a plurality of said connecting rods means whereby said connecting rod means have a connecting rod notch means which interconnects with said connecting rod slot means for erecting said mast ladder;

said lower portion of said top step means affixed to a universal step means by said connecting rod means;

a second means for coupling said universal step means to said sail slide;

whereby each universal step means thereafter is added having a connecting rod means affixed and said universal step means is rotated such that said universal step means alternates every other time on the left and on the right of said mast ladder to a desired height and an inverted halyard slide means for affixing to said sail slide by a third means for coupling and is affixed to said mast ladder by said connecting rod means.

2. The mast ladder of claim 1 wherein said top step means is an aluminum step.

3. The mast ladder of claim 1 wherein said halyard slide means is an aluminum halyard slide.

4. The mast ladder of claim 1 wherein said universal step means is an aluminum universal step.

5. The mast ladder of claim 1 wherein said connecting rod means is an aluminum connecting rod.

6. A mast ladder for use with a mast on a sailing craft having a sail slide along the length of the mast, the mast ladder comprising:

a top step having a upper portion and a lower portion for providing support to an individual when said mast ladder is raised;

a first means for coupling said top step to said sail slide;

a plurality of connecting rods whereby said connecting rods have a connecting rod notch which interconnects with said connecting rod slot for erecting said mast ladder;

a plurality of universal steps for forming a ladder;

said lower portion of said top step affixed to said universal step by said connecting rod;

second means for coupling said universal step to said sail slide;

whereby each universal step thereafter is added having a connecting rod affixed and said universal step is rotated such that said universal step alternates ever other time on the left and on the right of said mast ladder to a desired height and an inverted halyard slide for affixing to said sail slide by a third means for coupling and is affixed to said mast ladder by said connecting rod.

* * * * *